BEST AVAILABLE COPY

United States Patent [19]

Becker

[11] Patent Number: 4,997,136

[45] Date of Patent: Mar. 5, 1991

[54] HAMMER MILL PROVIDED WITH A DEVICE FOR LOCKING THE HAMMERS IN A RETRACTED POSITION IN THE DRUM

[76] Inventor: Arnaud Becker, 5 rue de l'Angle, 67170 Brumath, France

[21] Appl. No.: 466,672

[22] Filed: Jan. 17, 1990

[30] Foreign Application Priority Data

Jan. 17, 1989 [FR] France ..... 89 00843

[51] Int. Cl.[5] ..... B02C 13/16

[52] U.S. Cl. ..... 241/194; 241/191

[58] Field of Search ..... 241/191, 192, 193, 194, 241/195

[56] References Cited

U.S. PATENT DOCUMENTS 3,844,494 10/1974 Hightower .

4,214,716 7/1980 Jadouin ..... 241/194 X 4,313,575 2/1982 Stephaneu ..... 241/194

FOREIGN PATENT DOCUMENTS 3218802 11/1983 Fed. Rep. of Germany .

*Primary Examiner*—Timothy V. Eley

*Attorney, Agent, or Firm*—Young & Thompson

[57] ABSTRACT

A Hammer mill, comprising discs (1) mounted on a drive shaft (2), crosspieces (3) for spacing apart the discs (1), hammers (4) mounted between the discs (1) at intervals defined by the crosspieces (3) and spindles (5) for swingably mounting the hammers (4) and passing through the discs (1). A device (6) is provided for selectively individually locking the hammers (4) in a retracted position in the drum which drives the hammers (4), for releasing the hammers for outward swinging. The locking device is a fluid-actuated peg (7) insertable in and withdrawable from a hole (9) in each hammer.

3 Claims, 1 Drawing Sheet

BEST AVAILABLE CO
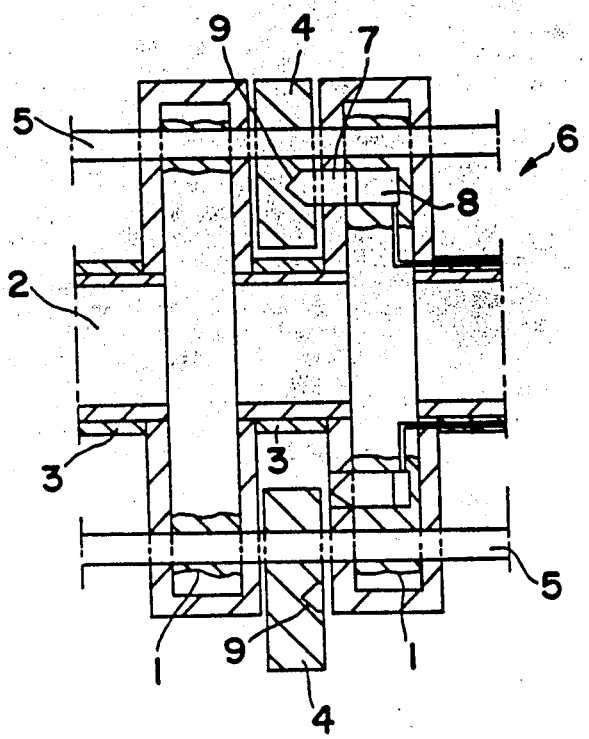
FIG.1
FIG.2
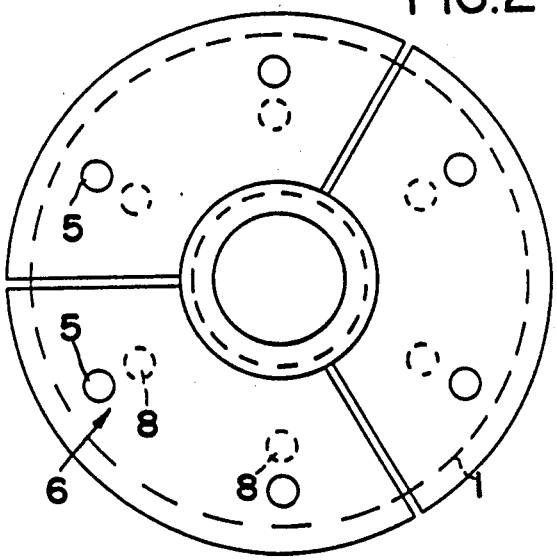

BEST AVAILABLE COPY

HAMMER MILL PROVIDED WITH A DEVICE FOR LOCKING THE HAMMERS IN A RETRACTED POSITION IN THE DRUM

FIELD OF THE INVENTION

The present invention concerns the field of recovery of metals from manufactured articles, particularly by milling with hammer mills, and has as an object a hammer mill provided with a device for locking the hammers in a retracted position in the drum.

BACKGROUND OF THE INVENTION

Recovery of metals from worn-out articles, particularly automotive vehicles, by means of crushers or grinders, is generally effected by introducing the articles into a hammer mill which tears and cuts up the material entering into the said mill, by interaction with one or several anvils, and which ejects and/or evacuates through sifting walls the resulting mechanical chips having a predetermined caliber.

In known mills, the hammers are generally mounted on a rotor constituted by an assembly of discs separated by crosspieces at the level of the fixation of the hammers which are eclipsable in the rotor and which turn freely about their axis of fixation. During operation, these hammers are subjected to wear and must accordingly be mounted in an invertible manner on their spindle, so as to prolong their useful life. To prevent such an inversion of the mounting, it has also been proposed to drive the rotor in a reversible manner.

Finally, depending on the materials to be milled, a greater or lesser number of hammers must be operated which consequently requires, upon each change of the material to be milled, an intervention on the rotor so as to mount or dismount a certain number of the hammers. Such interventions, however, present the disadvantage of relatively long down time of the machine, which considerably increases maintenance costs.

OBJECTS OF THE INVENTION

The present invention has as an object to overcome these disadvantages.

Specifically, it has as an object a hammer mill characterized in that it is provided with a device for locking the hammers in a retracted position in the drum which drives the hammers.

BRIEF DESCRIPTION OF THE DRAWING

The invention will be better understood from the following description, which refers to a preferred embodiment, given by way of non-limiting example and explained with reference to the accompanying schematic drawing, in which:

FIG. 1 is a partial view in side elevation and in section of a hammer drum according to the invention, and FIG. 2 is a view in front elevation of the drum according to FIG. 1.

DETAILED DESCRIPTION OF THE INVENTION

According to the invention and as is shown more particularly in FIGS. 1 and 2 of the accompanying drawing, the hammer mill, which comprises a drum for driving the hammers, essentially constituted by discs 1 mounted on a drive shaft 2, by crosspieces 3 for spacing apart the discs 1, by hammers 4 mounted between the discs at intervals defined by the crosspieces 3 and by pinions 5 connecting the hammers 4 traversing the discs 1, is characterized in that it is provided with a device 6 for locking the hammers in a retracted position in the drum which drives the hammers.

The device 6 for locking the hammers 4 in a retracted position in the drum is advantageously constituted by pegs 7 retractably disposed in the discs 1 by means of jacks 8 and each cooperating in service position, the hammers 4 being retracted between the discs 1, with a hole 9 of corresponding shape provided in at least one lateral face of the said hammers 4.

According to a characteristic of the invention, each hammer 4 is provided on at least one lateral face with at least one specific hole 9, passing all the way through or being blind, preferably conical or conical beginning at each face, each hole 9 being intended to cooperate with a corresponding peg 7 actuated by at least one jack 8 and being disposed offset from the hole which accommodates its articulation pinion 5.

The fluid supply conduits for controlling the jacks 8 are advantageously bored in the discs 1 and in the crosspieces 3 and are connected to an end panel connected to a central distribution unit through the intermediary of valves. Such an end panel and corresponding distribution valves are known in the art, and are not described in detail.

According to a characteristic of the invention, the control jacks 8 for the pegs 7 are auto-locking jacks and are actuated by diametrally opposed pairs of jacks, a manometric contact (not shown) being provided for each jack 8 and detecting the arrival at the end of its course of penetration of the pegs 7 in the corresponding holes 9 of the hammers 4. Thus, a perfectly correct and imbalance-free operation is continuously assured.

Thanks to the invention, it is possible to provide a device permitting selective retraction or selective liberation of the hammers of a hammer mill as a function of the products to be milled. In addition, thanks to this embodiment, the drum for driving the hammers may be provided with a maximum of hammers, certain of which could be freed, for example, after wearing of the drums in service and always such that the drum rotates without imbalance.

The device according to the invention is particularly advantageous in the case where a reversible drum is used, because it permits increasing the autonomous operation of this drum by preventing a significant number of changings of the drums or remounting of the drums.

It will be understood that the invention is not limited to the embodiment described and shown in the accompanying drawing. Modifications remain possible, especially from the point of view of the constitution of the various elements or by substitution of equivalent techniques, without departing whatsoever from the scope of protection of the invention.

I claim:

1. Hammer mill, comprising discs (1) mounted on a drive shaft (2), crosspieces (3) spacing apart the discs (1), hammers (4) mounted between the discs (1) at intervals defined by the crosspieces (3), spindles (5) on which the hammers (4) are swingably mounted, said spindles passing through the discs (1), and means (6) for selectively individually locking the hammers (4) in a retracted position between the discs or freeing the hammers for movement to an extended position.

BEST AVAILABLE COPY

2. Mill according to claim 1, wherein said means (6) for locking the hammers (4) in a retracted position comprises pegs (7) retractably disposed in the discs (1) by means of jacks (8) and each being receivable, the hammers (4) being retracted between the discs (1), in a hole (9) of corresponding shape provided in at least one lateral face of the said hammers (4).

3. Mill according to claim 2, said holes (9) being spaced from said spindles (5).

* * * * *